United States Patent [19]

Bihler

[11] 4,132,106

[45] Jan. 2, 1979

[54] METHOD FOR BENDING WIRE OR STRIP MATERIAL INTO ROUND PARTS

[76] Inventor: Otto Bihler, Schleiferweg 2, Halblech near Fussen, Fed. Rep. of Germany, 8959

[21] Appl. No.: 795,164

[22] Filed: May 9, 1977

[30] Foreign Application Priority Data

May 11, 1976 [DE] Fed. Rep. of Germany ..... 2620768

[51] Int. Cl.[2] ..... B21D 7/04; B21D 9/05; B21F 37/00

[52] U.S. Cl. ..... 72/384; 72/149; 72/405; 72/414; 140/88

[58] Field of Search ..... 29/148.4 C, 159.1; 72/129, 131, 132, 149, 151, 156, 384, 403, 404, 405, 414; 140/88

[56] References Cited

U.S. PATENT DOCUMENTS

| | | | |
|---|---|---|---|
| 1,773,566 | 8/1930 | Boyle | 72/129 X |
| 1,978,685 | 10/1934 | Mogford et al. | 72/414 X |
| 3,142,887 | 8/1964 | Hulck et al. | 29/148.4 C |
| 3,365,775 | 1/1968 | Cavagnero et al. | 29/148.4 C |
| 3,580,030 | 5/1971 | Bean et al. | 140/88 X |

FOREIGN PATENT DOCUMENTS

| | | | |
|---|---|---|---|
| 420013 | 10/1925 | Fed. Rep. of Germany | 72/386 |

*Primary Examiner*—E. M. Combs
*Attorney, Agent, or Firm*—Hans Berman

[57] ABSTRACT

In each cycle of a sequence of repetitive cycles a longitudinal section of an elongated, continuous piece of material spaced from the free end of the piece is draped about an arcuate face of a mandrel by a bending tool moving about the axis of curvature of the mandrel face, and the free end of the piece is thereby engaged with the arcuate face of another mandrel and secured to the other mandrel, whereupon the section draped over the first mandrel is cut. The central portion of the blank severed thereby from the continuous piece is draped over the second mandrel bent into a ring, the curvature of the leading and trailing blank portion, being due to previous draping over the first mandrel.

7 Claims, 8 Drawing Figures

METHOD FOR BENDING WIRE OR STRIP MATERIAL INTO ROUND PARTS

The invention relates to a method of bending a blank of strip or wire material into closed rings in which the end sections of the blank are bent first, and the central section remaining between the end sections is bent thereafter, and to apparatus for performing the method.

In the conventional production of round parts by such a method, the curved pieces of material are found not to have the same curvature near their ends as in the remainder of the piece of material. This is due to the fact that deformation of the piece of material — as viewed in the direction of the circumference of the bent piece of material — is caused to occur in spot x by pressure applied to the piece of material at a distance a in front or behind the spot x, but not by pressure applied to the material in the spot x itself. The section of material of length a acts as a lever arm to produce a bending moment in the spot x. Such a lever arm is missing at the two ends of a piece of material to be bent, and an unobjectionable curvature of the piece of material cannot be achieved near its ends even at relatively high pressures of the bending tools.

As a consequence, the ends of the piece of material, when bent into a ring, do not abut against each other at the junction point in a direction exactly parallel to a tangent drawn on the ring at the junction point but at a slight angle to this tangent. The circumference of the ring thus has a slight kink at this point which may need to be evened after welding of the ends of the piece of material to obtain a uniform radius at the welding point as well.

It is the object of the invention to provide a method and apparatus for performance of the method in which bending of the piece of material with the desired radius of curvature over the entire length of the piece of material can be achieved at lowest possible cost.

For achieving this object, it is proposed according to the invention that the material, as yet undivided, be bent at a distance from its leading end corresponding to the length of the ring blank, and that a dividing cut be made in the bending zone, whereby the portions of the bending zone on the two sides of the dividing cut constitute a curved, trailing end of a leading blank and a curved leading end of a trailing blank. In this manner, practically ideally curved ends of the blank are obtained without using extremely high bending pressures, only the first piece of material severed from a strip of material and lacking a curved leading end being scrap.

More specifically, one may proceed in such a manner that the continuous material is led tangentially to a first bending mandrel and beyond the same over the length of one blank, thereafter bent about the first bending mandrel by means of a bending tool cooperating with the first bending mandrel, the leading end of the piece, bent in a preceding bending operation, being simultaneously engaged with a second bending mandrel whereupon a dividing cut is made in the area of the first bending mandrel. The central section of the blank severed thereby is bent over the second bending mandrel by means of a second bending tool. The method of the invention is applicable to the production of continuously curved parts of any curve shape, that is, not only of rings of circular curvature.

The invention further provides apparatus for performing the method of the invention which includes a material feeding device, a first bending mandrel, a first bending tool, a second bending mandrel, a second bending tool opposite this second bending mandrel, and a cut-off device, in a manner known in itself, and is further improved according to the invention in such a manner that the first bending tool is arranged at a distance from the surface of the first bending mandrel to define a gap passing the material and for reciprocating turning movement about the axis of the mandrel between a bending start position and a bending termination position, the cut-off device being arranged opposite the first bending mandrel in an area between the bending start position and bending termination position of the first bending tool and controlled in such a manner that it performs a separating cut after every return of the first bending tool into its bending start position.

Additional features and advantages of the apparatus according to the invention are evident from the following description.

The enclosed drawing illustrates embodiments of the invention. In the drawing.

Figure 1:
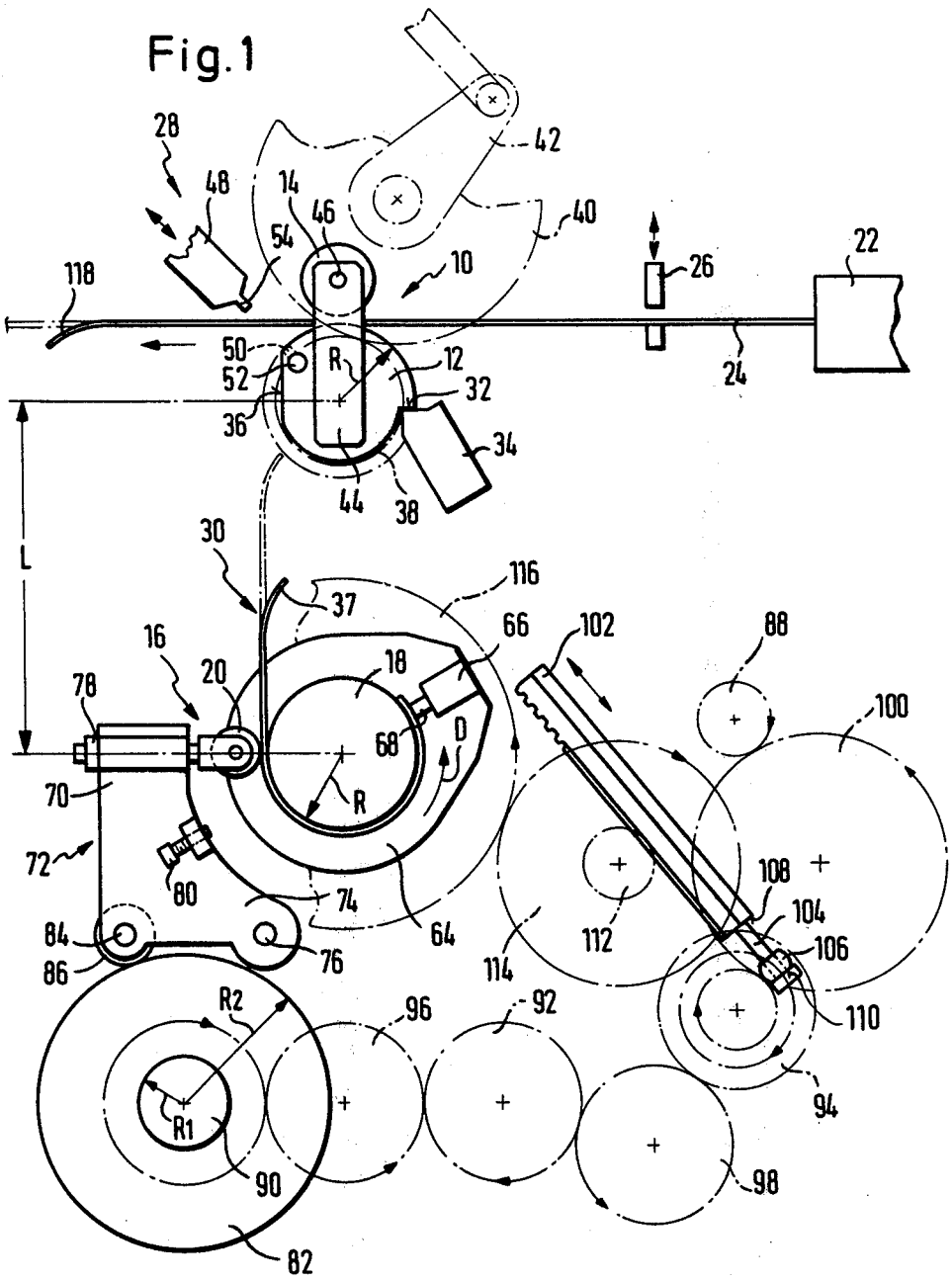
FIG. 1 shows elements of an arrangement of the invention for bending strip or wire material into round parts in a simplified view.
Figure 3:
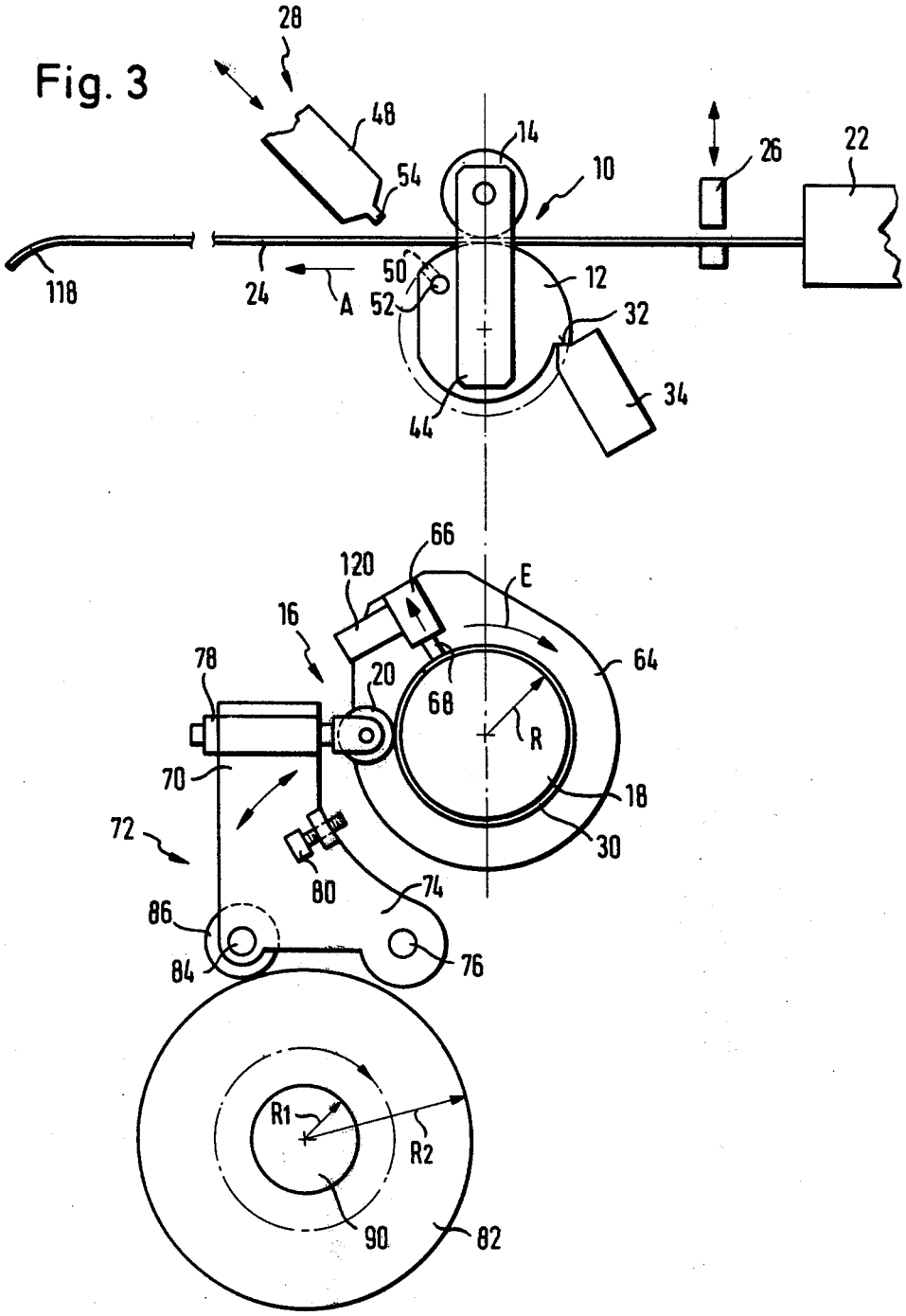
Figure 4:
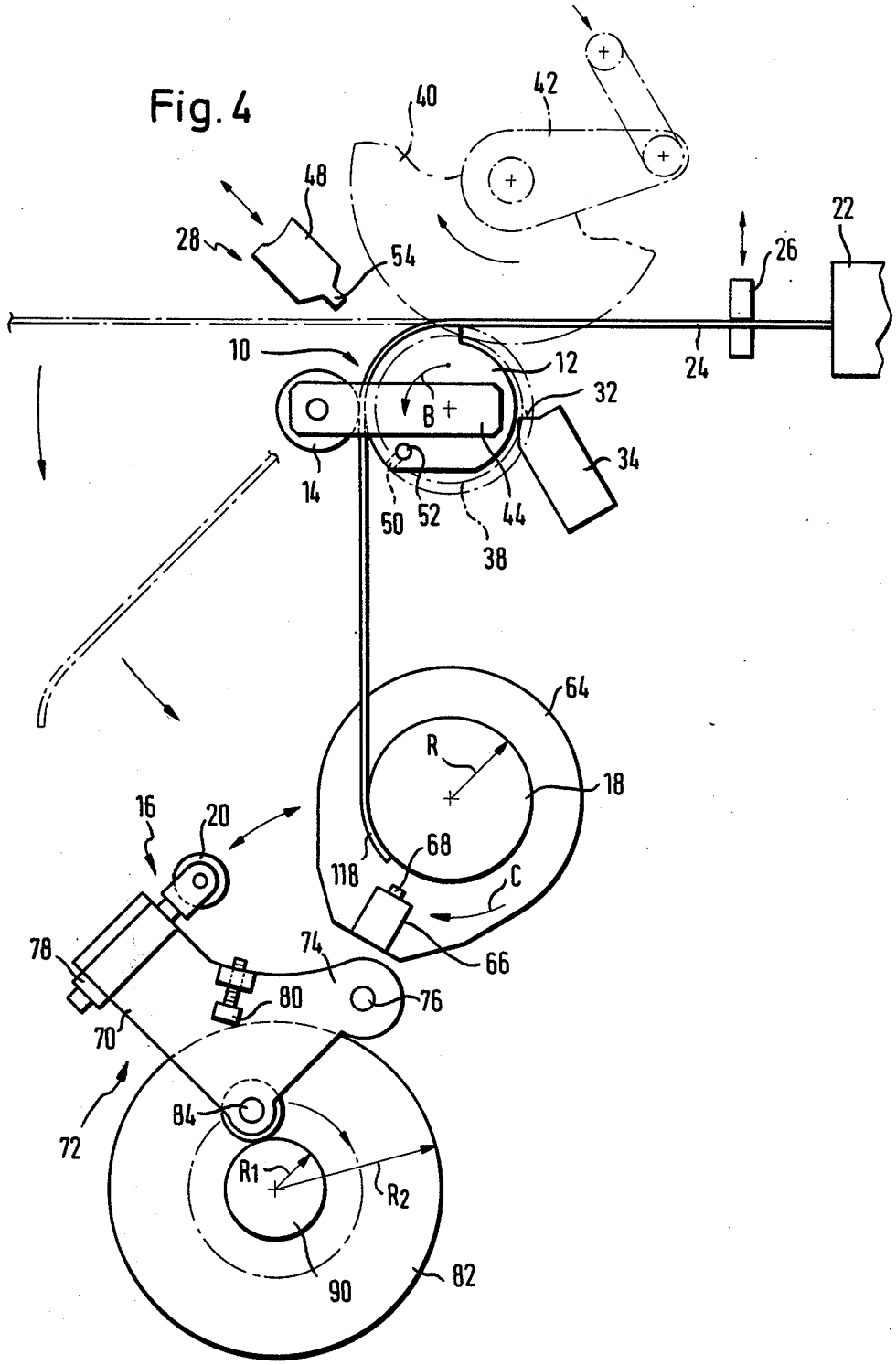
Figure 5:
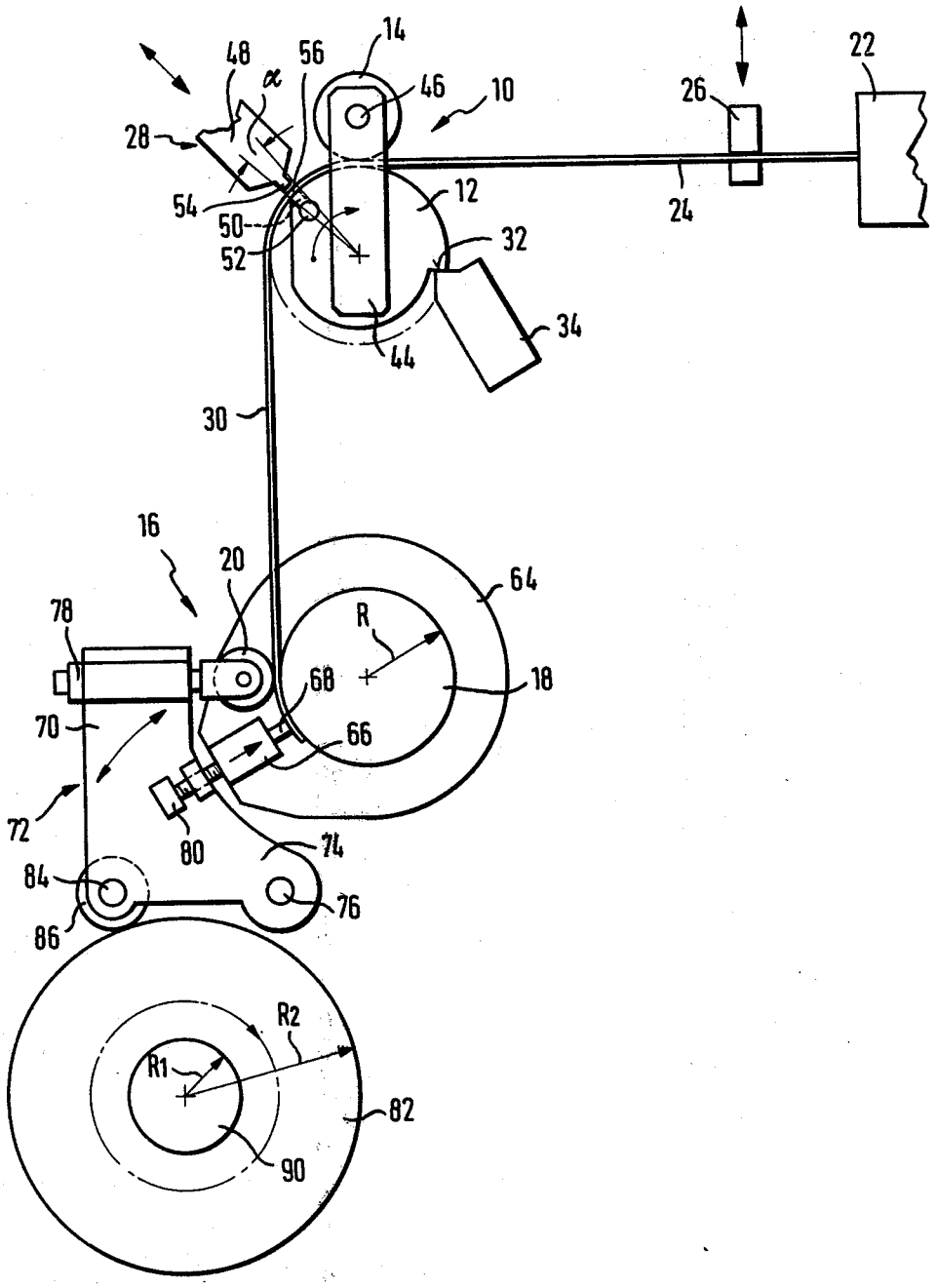
Figure 6:
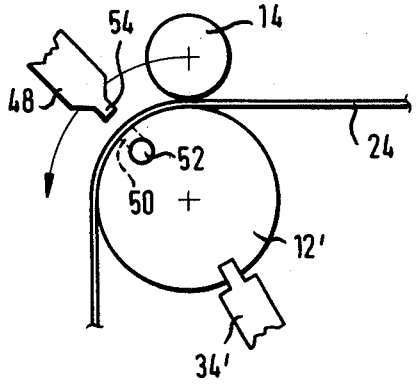
Figure 7:
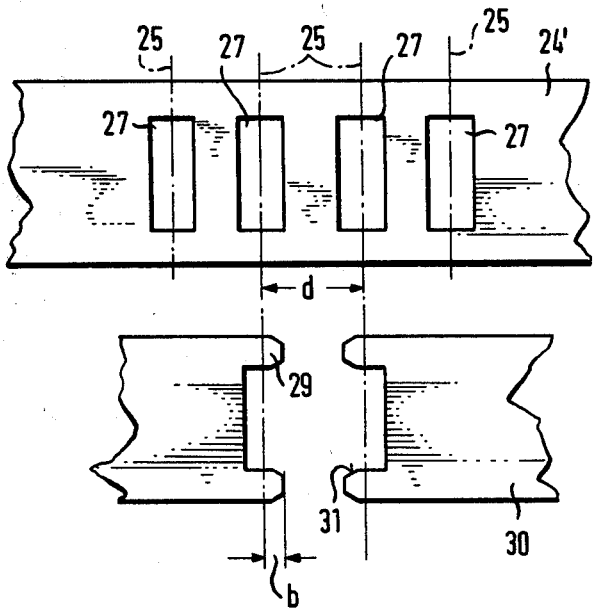

FIGS. 3, 4, and 5 show the apparatus of FIG. 1 in different operating stages, a showing of the drive having been omitted;

FIG. 6 shows an alternative first bending unit for the arrangement of FIG. 1;

FIG. 7 shows a strip of blank material for needle bearing cages; and

Figure 8:
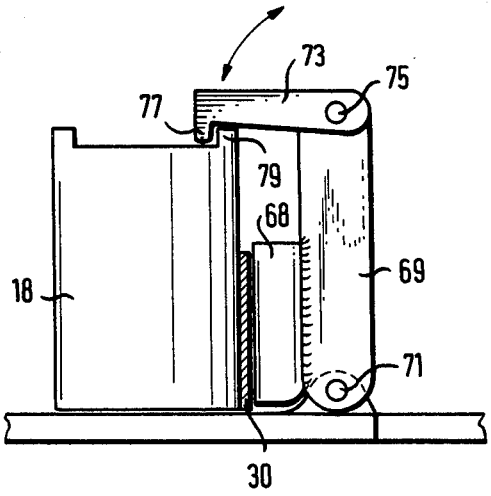

FIG. 8 shows a clamping device the arrangement of FIG. 1 in more detail.

In FIG. 1, there is seen a first bending unit 10 including a first bending mandrel 12 and a first bending roll 14. A second bending unit 16 including a second bending mandrel 18 and a second bending roll 20 is arranged at a distance L to be defined below. The two bending units 10, 16 are driven by means of shafts and gears indicated by chain-dotted lines and explained hereinafter in more detail. There is further indicated schematically in FIG. 1 a feeding device 22 for feeding a continuous strip of material 24 to the bending apparatus, a clamping device 26 for clamping the strip 24 during certain operating stages of the apparatus, and a cut-off device 28 for severing pieces of material or blanks 30 from the strip 24. The parts of the bending apparatus illustrated in FIG. 1 are arranged at or on a common work platform, not shown.

The bending mandrel 12 is cylindrically shaped, a first section of the axial surface of the cylinder — as viewed in section at right angles to the axis — having a radius R which corresponds to the radius of curvature of the parts to be bent. A second section of the axial cylinder surface has a smaller radius so that an abutment face 32 is formed at a shoulder between the first and the second section, the face being intended for engagement by an abutment 34. In a section of the circumference of the mandrel 12, the axial cylinder surface is replaced by a planar face 36 parallel to the axis so that the blank 30 may be withdrawn freely from the mandrel 12 without its trailing end 37 being caught. The mandrel is mounted releasably on a non-illustrated shaft so that it may be replaced by a mandrel of different bending radius.

A gear wheel 38 is fastened to the non-illustrated shaft and driven by a toothed segment 40. The toothed segment may be reciprocated by a lever assembly 42 connected to a non-illustrated slide unit, the slide unit itself being controlled in a known manner by means of a cam disk.

The bending roll 14 is supported by means of a lug 44, rigidly mounted on the mandrel 12 at a distance from the mandrel 12 for rotation about shaft 46 parallel to the axis of the mandrel 12. The spacing between the bending roll 14 and the bending mandrel 12 corresponds substantially to the thickness of the material to be bent.

In the alternative bending unit shown partly in FIG. 6, a first bending mandrel 12', also of cylindrical shape, is not connected to the bending roll 14 for joint rotation, but set on the non-illustrated shaft and prevented from turning by a stop 34'. The mandrel thus stands still while the roll 14 rolls on the mandrel 12' or the strip of material 24 curved about the bending mandrel 12'.

The cut-off device 28 shown in FIG. 1 includes a punch 48 which may be moved back and forth in a direction radial relative to the mandrel 12 by means of a slide unit, not shown. The mandrel 12 has a radially open groove 50 parallel to its axis which extends from the cylindrical surface of the mandrel in a radially inward direction to a bore 52 parallel to the axis of the mandrel. In the start position of the bending mandrel 12 and of the roll 14, as shown in FIGS. 1, 3, and 5, the groove 50 is aligned with the direction of movement of the punch 48. When the blank 30 is to be severed from the strip 24, the punch 48 is advanced radially toward the mandrel in the manner illustrated in FIG. 5, so that a cutting rib 54 at its front end severs the blank 30 from the strip 24 by punching out a material section 56 corresponding to the width of the cutting rib 54 or the groove 50. The section 56 reaches the bore 52 from which it may be removed by means of compressed air.

Figure 2:
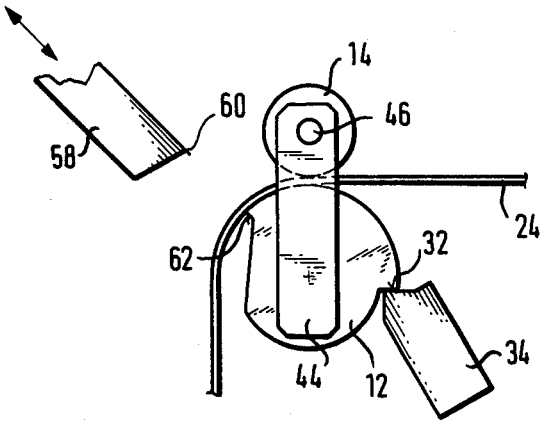
FIG. 2 shows another cut-off device for the arrangement shown in FIG. 1.

A modification of the cut-off device 28 is illustrated in FIG. 2. The punch 48 is replaced by a knife 58 movable back and forth in the same manner. Its cutting edge 60 cooperates with an opposite edge 62 on the mandrel 12 for severing the blank 30 from the strip 24 no scrap loss occurs. Which of the cut-off devices is to be used depends on the material to be worked.

As is apparent from FIG. 7, it may be advantageous in producing needle bearing cages from a pre-punched strip of material to accept a certain amount of cutting scrap loss in the form of the material sections 56 in order to permit a precise and stable connection between the ends of the blank for the needle bearing cage. In FIG. 7, the distance between the center lines 25 — as viewed longitudinally of the strip of material 24' — of two adjacent punched openings 27 is designed d. The width of the material section 56 cut out by means of the cut-off device amounts preferably to d — 2*b* so that the ends 29 of the cut ends directed toward each other in the direction of elongation of the strip 24' are each too long by b. When the ends of a blank 30 are joined by welding to form a needle bearing cage, these excess lengths 2*b* are melted away so that the width of the opening in the area of the welding junction corresponds again to the width of the punched openings 27.

The cutting rib 54 is preferably shaped in such a manner that the ends 29 are bevelled in the manner evident from FIG. 7. The oblique faces 31 permit the ends to be welded together without a burr, thus making secondary working of the needle bearing cage unnecessary.

The second bending mandrel 18 shown in FIG. 1 is a cylinder of radius R and is releasably and coaxially fastened on a turntable 64. A clamping device 66 is arranged on the turntable 64 and included a radially movable ram 68 which presses the leading end of the blank 30 against the mandrel 18 (FIG. 5) and thereby entrains the blank 30 during rotation of the turntable 64. The clamping device is illustrated in more detail in FIG. 8.

The ram 68 is fastened to an arm 69 which may be pivoted about a shaft 71 between a releasing position and the clamping position shown in FIG. 8. It is held in the clamping position by a detent 73 which is hinged to the swinging arm 69 for pivotal movement about a pivot shaft 75 and whose nose 77 engages a matingly shaped projection 79 on the mandrel 18.

The roll 20 cooperating with the bending mandrel 18 is arranged at the free end of one leg 70 of an angle lever 72. The free end of the other leg 74 of the lever 72 is pivotally mounted on a shaft 76 parallel to the axis of the mandrel 18 so that the bending roll 20 may be toward and away from the mandrel between a material entry position (FIG. 4) and a bending position (FIGS. 1, 3, and 5).

The roll 20 is fastened to the leg 70 by means of an adjusting spindle 78 so that the spacing of the roll 20 from the mandrel 18 may be set according to the thickness of the blank 30 which is to be bent.

The clamping device there is operated by an adjustable pin 80 on the angle lever 72 in such a manner that the pin 80 presses the ram 68 radially of the bending mandrel 18 against the blank 30 when the roll 20 is swung toward the mandrel 18 whereupon, the detent 73 illustrated in FIG. 8, holds the ram 68 in its clamping position.

The pivotal movement of the angle lever 72 is controlled by a radial cam 82 whose cam face is engaged by a cam follower roller 86 rotatably mounted on a shaft 84 near the angle vertex of the angle lever 72, the cam follower roller 86 being held in continuous contact with the cam face by spring tension or a guide. The cam is not illustrated in detail. The distance of the points defining the cam face from the axis of rotation of the cam disk 82 varies between the limits R1 and R2, the minimum distance R1 corresponding to the material entry position and the maximum distance R2 corresponding to the bending position of the roll 20.

The mandrel 18 and the cam 82 are driven by way of various drive elements from a drive shaft 88. The drive elements only sketchily shown illustrate only the basic design of the drive without considering the actual speed reducing or increasing ratios.

Driving motion is transmitted from the drive shaft 88 to a control shaft 90 carrying the cam 82 by way of two further control shafts 92, 94 and over intermediate wheels 96, 98, 100 arranged respectively between the control shafts 90, 92, 94 and the drive shaft 88. Whereas the control shafts are directly connected with the driven cams, bending units, and the like, the intermediate wheels serve only for transmitting driving motion at the desired rotary speed and direction of rotation. At least the intermediate wheel 100 is mounted on a change gear bracket to permit the drive to be adjusted to a change in the spacing L between the two axes of the bending mandrels 12, 18 by adjusting the position of the intermediate wheel 100.

One end of a rack 102 is eccentrically pivoted to the control shaft 94 in the manner of a connecting rod. A bar 104 at the end of the rack 102 is guided in a sleeve 106 mounted rotatably and eccentrically on the control shaft 94 in such a manner that the sleeve 106 may slide back and forth between a first abutment 108 on the rack 102 and a second abutment 110 at the free end of the bar 104.

The rack 102 meshes with a gear 112 which is rigidly connected with an intermediate wheel 114. The latter, in turn, drives a drive wheel 116 mounted on the shaft of the bending mandrel 18 and secured to the mandrel for joint rotation. The eccentric movement causes a back and forth movement of the rack 102 and thereby a back and forth turning of the turntable 64 and the mandrel 18. The angular stroke of the turntable 64 may be determined by the transmission ratio between the gear elements. The sliding movement of the sleeve 106 on the rack 102 between the abutments 108, 110 causes lost motion of the eccentric at the points of direction reversal of the rack 102 so that no motion is transmitted to the turntable 64 or the mandrel 18 during the period corresponding to the lost motion. This resting position of the mandrel 18 may be used for locking or unlocking the clamping device 66 and for discharging the finished, bent blank 30.

The afore-described apparatus operates as follows from the condition shown in FIGS. 1 to 5, after at least one complete bending cycle has occurred so that the leading end 118 of the strip 24 already has the desired curvature. The first piece of material severed from a strip of material newly introduced into the bending apparatus is scrap because the leading end remains straight.

According to FIGS. 1 and 3, the strip of material 24, for example a pre-punched material to be bent into needle bearing cages, is fed by the feeding device 22 through and beyond the gap between the mandrel 12 and the roll 14 by a distance corresponding to the length of the desired blank 30. Thereafter the strip 24 is clamped fast by the clamping device 26 (FIGS. 4 and 5), and the mandrel 12 and roll 14 are turned jointly about the axis of the mandrel 12 in the direction of the arrow B from a bending start position into the bending termination position through a bending angle (FIG. 4) which amounts to 90° in the illustrated example, but may be greater or smaller depending on the shape of the part to be bent. The surface of the mandrel 12 slides along one face of the strip while the roll 14 rolls over the opposite face and bends the strip about the mandrel 12 until the leading strip end 118 engages the second bending mandrel 18 (FIG. 4). Simultaneously with the clamping of the strip 24 by the clamping device 26, the angle lever 72 swings away from the mandrel 18 so that the second roll 20 is not located in the path of swinging movement of the leading end 118.

The mode of operation of the modified bending unit illustrated in FIG. 6 differs from that described above only in that bending mandrel 12' remains stationary while the bending roll 14 on the non-illustrated lug 44 is swung about the axis of the mandrel and thereby rolls the strip 24 about the mandrel 12'. Because the mandrel 12' is not flattened in the manner of the mandrel 12, the trailing end 37 of the severed blank slides over the cylindrical surface of the mandrel 12' during withdrawal 30 from the mandrel 12' and is bent slightly outward. This usually has no disadvantageous consequences, at least as long as the spacing L of the axes of the two bending mandrels is not very small.

After the strip was draped about the first bending mandrel 12, the mandrel 12 and the roll 14 turn back toward their bending start positions illustrated in FIGS. 1, 3, and 5, until the abutment face 32 of the mandrel 12 engages the abutment 34. Simultaneously, the turntable 64 turns in the direction of the arrow C into its bending start position and the angle lever 72 swings toward the mandrel 18 so that the roll 20 engages a previously bent portion of the strip 24 lying on the mandrel 18 (FIG. 5). The operating pin 80 hits the clamping device 66 and causes the leading end 118 of the strip 24 to be clamped fast on the second bending mandrel 18 by means of the clamping ram 68.

After clamping of the leading end 118, the blank 30 is severed from the strip 24 by means of the punch 48 (FIG. 5). The scrap section 56 corresponds to a segment of a circular arc of length $2R\pi\alpha/360°$, wherein $\alpha$ is the central angle of the punched out circular arc segment. If the punch 48 moves on the line bisecting the right angle between the bending start position and the bending termination position of the bending roll 14, the length of the curved trailing end 37 of the blank 30 and of the curved leading end 118 of the strip 24 equals $2R\pi(45° - \alpha/2)/360°$. The length of the straight section betwen the two curved ends of the blank 30, that is, the radial spacing L of the axes of rotation of the two bending mandrels 12, 18 must be equal to $2R\pi(270° + \alpha)/360°$. The length of the removed scrap must be taken into consideration in feeding the strip 24. If a knife 58 is used instead of the punch 48 so that no cutting scrap is formed, the lengths of the curved ends of the blank 30 under otherwise identical conditions equal $R\pi/4$ and the spacing L equals $3R\pi/4$. In practical applications, the length of the cutting scrap may amount to 2 to 10 mm.

After severing of the blank 30 from the strip 24, the turntable 64 turns in the direction of the arrow D (FIG. 1), the blank 30 being taken along by the clamping device 66 and being bent by the bending roll 20 about the mandrel 18 until the trailing end 37 of the blank 30 engages the mandrel 18, and the leading end 118 and trailing end 37 abut against each other, thereby forming a closed ring (FIG. 3). The turning angle of the turntable 64 is preferably selected so that the effect of the bending roll 20 extends into the zone of the workpiece end already previously bent. In this position, the blank device 66 strikes a stationary abutment 120 for releasing the ram 68 so that the finished bent blank 30 can be ejected from the mandrel 18 in an axial direction. The abutment 120 may also be arranged in such a manner that it causes release of the ram 68 during the backward turning of the turntable 64 in the direction of the arrow E (FIG. 3). In this manner, the butt joint between the two ends of the blank 30 can be brought into a certain position advantageous for further working of the bent part.

The strip 24 is again advanced after release of the clamping device 26 while bending of the blank 30 is being completed by the second bending unit 16, and the stages of the process are repeated in the manner described.

As is evident from the preceding description, practically ideally curved ends are obtained on the blank 30 by locating the separating cut in the area previously bent. The bending angle at the first bending device 10 may be smaller or greater than 90°, and the severing cut need not be located in the line bisecting the bending angle. The method of the invention is not limited to the bending of round pieces of circular curvature.

I claim:

1. A method of making a plurality of curved shapes of predetermined length from respective, longitudinally sequential sections of an elongated piece of material having an initial free, leading end of arcuately bent shape in a sequence of repetitive cycles, each cycle comprising the steps of:

(a) draping a longitudinal section of said piece spaced from said free end a distance approximately equal to said predetermined length over a first mandrel until said free end engages a second mandrel, and thereby arcuately bending said section;

(b) securing said free end to said second mandrel; (c) transversely cutting the bent section while backed by said first mandrel, and thereby severing a newly formed, arcuately bent, free end of said continuous piece of material from a blank secured to said second mandrel by said initial free end and further including an arcuately bent trailing end and a portion intermediate said ends; and (d) draping said intermediate portion about said second mandrel while keeping said initial free end secured to said second mandrel.

2. A method as set forth in claim 1, wherein said longitudinal section and said intermediate portion of said blank are substantially straight prior to said draping thereof over said mandrels respectively.

3. A method as set forth in claim 1, wherein said intermediate portion is bent until said initial free end and said trailing end are contiguously adjacent, and fixedly connecting said initially free and trailing ends.

4. A method as set forth in claim 3, wherein said ends are connected by welding.

5. A method as set forth in claim 3, wherein respective longitudinally terminal faces of said ends are beveled prior to said connecting to make said terminal faces obliquely inclined to the direction of elongation of said section, and connecting said ends in conformingly superimposed position of said faces.

6. A method as set forth in claim 5, wherein said terminal faces are beveled during said cutting.

7. A method as set forth in claim 1, wherein said piece of material is a strip of metallic material having a width greater than the thickness thereof.

* * * * *